US006952934B2

(12) United States Patent
Lee

(10) Patent No.: US 6,952,934 B2
(45) Date of Patent: Oct. 11, 2005

(54) SELF-COOLING LIQUID CONTAINER

(76) Inventor: Jung Min Lee, 1208 Misung Apt. A-dong, 37 Yeoueudo-dong, Youngdungpo-gu, Seoul 150-010 (KR)

( * ) Notice: Subject to any disclaimer, the term of this patent is extended or adjusted under 35 U.S.C. 154(b) by 78 days.

(21) Appl. No.: 10/258,329

(22) PCT Filed: Apr. 23, 2001

(86) PCT No.: PCT/KR01/00672

§ 371 (c)(1),
(2), (4) Date: Apr. 10, 2003

(87) PCT Pub. No.: WO01/90666

PCT Pub. Date: Nov. 29, 2001

(65) Prior Publication Data

US 2003/0159448 A1 Aug. 28, 2003

(30) Foreign Application Priority Data

| | | |
|---|---|---|
| Apr. 22, 2000 | (KR) | 2000-21549 |
| Jun. 5, 2000 | (KR) | 2000-31487 |
| Jun. 5, 2000 | (KR) | 2000-31488 |
| Oct. 20, 2000 | (KR) | 2000-62741 |

(51) Int. Cl.[7] ..... F25D 3/10
(52) U.S. Cl. ..... 62/293; 62/371
(58) Field of Search ..... 62/293, 371, 457.3, 62/457.4

(56) References Cited

U.S. PATENT DOCUMENTS

| | | | | |
|---|---|---|---|---|
| 2,900,808 A | * | 8/1959 | Wang | 62/294 |
| 4,054,037 A | * | 10/1977 | Yoder | 62/224 |
| 4,628,703 A | * | 12/1986 | Kim | 62/294 |
| 4,669,273 A | * | 6/1987 | Fischer et al. | 62/294 |
| 5,331,817 A | * | 7/1994 | Anthony | 62/5 |
| 5,394,703 A | * | 3/1995 | Anthony | 62/5 |
| 5,571,233 A | * | 11/1996 | Rolland et al. | 62/293 |
| 5,765,385 A | * | 6/1998 | Childs | 62/293 |
| 6,109,057 A | * | 8/2000 | Shervington et al. | 62/371 |
| 6,128,906 A | * | 10/2000 | Sillince | 62/4 |

* cited by examiner

*Primary Examiner*—William E. Tapolcai
(74) *Attorney, Agent, or Firm*—Norris McLaughlin & Marcus PA

(57) ABSTRACT

The present invention relates to a self-cooling liquid container for rapidly cooling the liquid in a container by evaporation of coolant gas. A self-cooling liquid container having a liquid cooling device for cooling a liquid in a container by evaporation of a coolant gas comprises a coolant gas bottle inside the liquid container containing a coolant gas stored under pressure, a nozzle tube communicating with the coolant gas bottle and rounding outside the coolant gas bottle, a mounting support for mounting and supporting the coolant gas bottle inserted into the liquid container, and having a switching portion for selectively releasing the coolant gas, and a cap coupled with the mounting support outside of the container and selectively opening and closing the switching portion.

27 Claims, 27 Drawing Sheets

SELF-COOLING LIQUID CONTAINER

TECHNICAL FIELD

The present invention relates to a self-cooling liquid container for rapidly cooling the liquid in a container by evaporation of coolant gas.

BACKGROUND ART

Generally, cooling of beverage contained in a container such as a bottle, can, pet bottle is accomplished by storing in a cooling apparatus such as a refrigerator. But in summer it takes long time to cool the beverage.

The prior art of using a freon gas has a problem of destruction of ozone layer.

Korean Patent Registration No. 240,195 discloses a prior art of the invention. The prior art discloses a portable cooling device comprising a coolant gas bottle for storing a coolant gas, a coolant gas rod for emitting the coolant gas stored in the coolant gas bottle, a cap coupled to a top of the coolant gas rod and a coolant gas bottle case for protecting the coolant gas bottle. It is portable but can not be applied into an airtight container such as a can.

Further, Korean Patent Registration No. 240,197 discloses a prior art of the invention. The prior art discloses a beverage can having an internal cooling means. The internal cooling means is provided with an upper surface member and a bottom surface member with interval, a sponge is inserted between the upper and bottom surface member and the coolant gas is absorbed into the sponge through the bottom surface member thereby preventing an accident of explosion. As the coolant gas is stored in the bottom of the can, the beverage in the can is not able to be proportionally entirely cooled and the internal capacity of the can is reduced.

DISCLOSURE OF INVENTION

Therefore, the present invention has been made in an effort to solve the problem. It is an objective of the present invention to provide a self-cooling liquid container having a helical coolant gas tube thereby improving cooling efficiency.

It is another object of the present invention to provide a self-cooling liquid container that is designed to increase a contact surface of a beverage and cooling device thereby improving cooling efficiency and reducing the time of cooling the beverage.

It is still another object of the present invention to provide a self-cooling liquid container that is designed to control the emitting degrees of the coolant gas thereby controlling the temperature of the beverage.

It is a still further object of the present invention to provide a self-cooling liquid container that has a simple design and is stably worked in any case.

To achieve the above objects, the present invention provides a self-cooling liquid container having a liquid cooling device for cooling a liquid in a container by evaporation of a coolant gas comprising a coolant gas bottle inside the liquid container containing a coolant gas stored under pressure, a nozzle tube communicating with the coolant gas bottle and rounding outside the coolant gas bottle, a mounting support for mounting and supporting the coolant gas bottle inserted into the liquid container, and having a switching portion for selectively releasing the coolant gas, and a cap coupled with the mounting support outside of the container and selectively opening and closing the switching portion.

BRIEF DESCRIPTION OF DRAWINGS

The accompanying drawings, which are incorporated in and constitute a part of the specification, illustrate an embodiment of the invention, and, together with the description, serve to explain the principles of the invention.

BEST MODE FOR CARRYING OUT THE INVENTION

Figure 1:
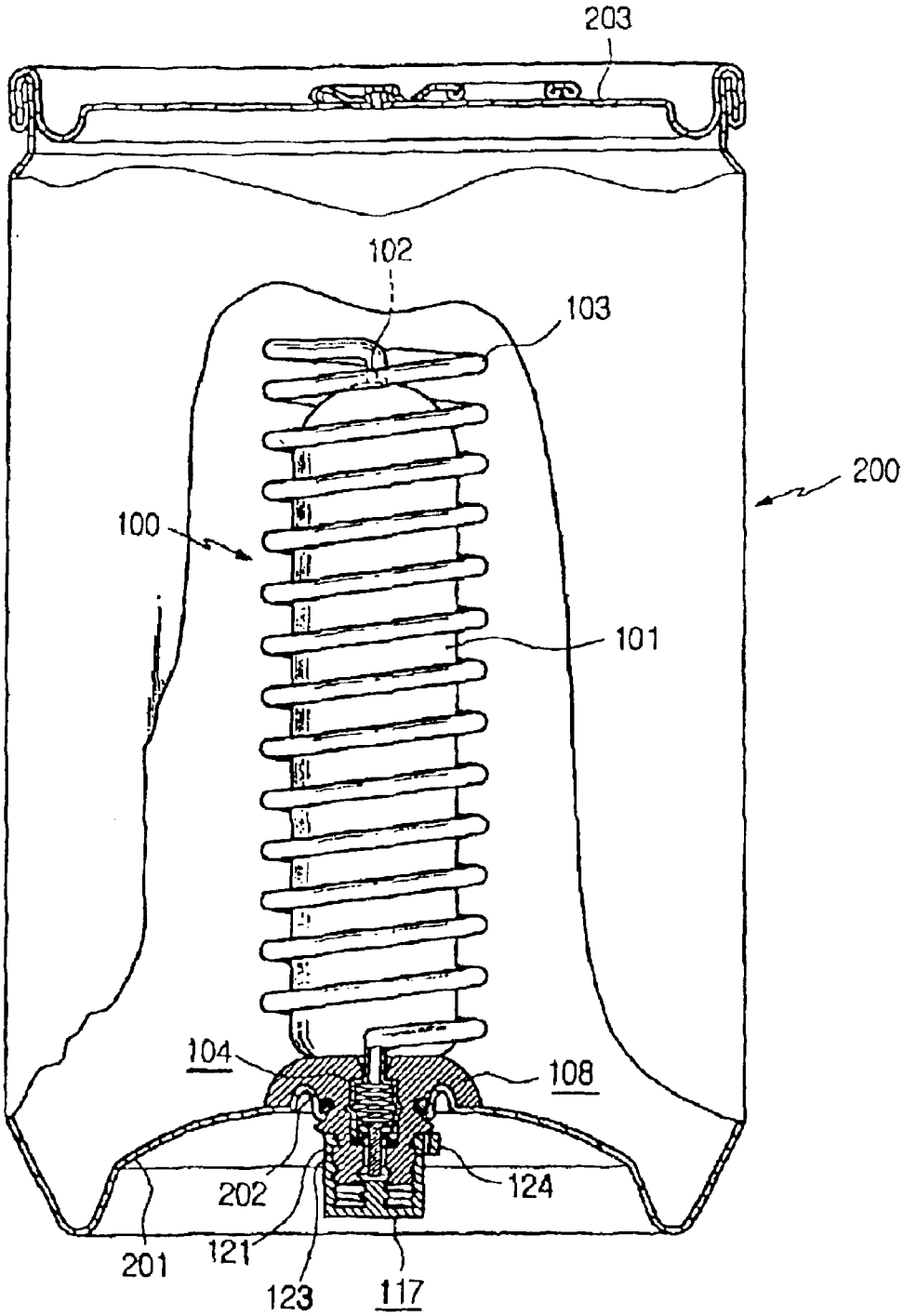
FIG. 1 is a partly sectional view of a self-cooling liquid container having a self-cooling device of the present invention.

A preferred embodiment of the present invention will be described in detail with reference to the accompanying drawings.

FIGS. 1 to 7 shows a self-cooling liquid container having a liquid cooling device where the liquid cooling device 100 is mounted in the container 200.

The liquid cooling device 100 is provided with a coolant gas bottle 101 inside the liquid container 200 containing a coolant gas stored under pressure. The top end of the coolant gas bottle 101 is formed with a nozzle portion 102. The nozzle portion 102 communicates with an end of a nozzle tube 103.

The nozzle tube 103 is helical-extended and the other end of the nozzle tube 103 is provided with a switching portion 104 for selectively releasing the coolant gas.

The diameter of the switching portion 104 is larger than that of the nozzle tube 103 and the switching portion 104 is provided at its inside with a spring 105. The switching portion 104 is provided with a switching protrusion 106 downwardly forced by the inner spring 105. A packing 107 is inserted between the switching protrusion 106 and switching portion 104.

The switching portion 104 is fixedly mounted on a mounting support 108 mounted on a bottom of the container 200.

The mounting support 108 is preferably formed with synthetic resins for having an elasticity.

The mounting support 108 is provided with an annular coupling groove 109 and an annular protrusion 110 to coupled with a bending portion 202 of a punching portion of a bottom portion 201, and a seal-ring 111 is inserted between the annular coupling groove 109 and the annular protrusion 110 for sealing with the container 200.

The annular protrusion 110 is provided at it bottom with a skirt inserting groove 112 and a male screw portion 113, and the mounting support 108 is provided at its inside with a switching portion inserting groove 114 for inserting and fixing the switching portion 104.

A packing 115 is inserted below the switching portion inserting groove 114 for sealing after inserting the switching portion 104. The switching portion inserting groove 114 is formed with a hole 114*a* and an annular groove 116 is formed inside the hole 114*a*.

A cap 117 is coupled to the male screw portion 113 of the mounting support 108.

The cap 117 is composed of an end portion 118 and a side wall portion 119. The inner surface of the side wall portion 119 is formed with a female screw portion 120 coupled with the male screw portion 113.

A skirt 121 and an annular protrusion 122 is formed at the upper part of the female screw portion 120. The skirt 121 is formed with an separating guide line 123.

At one side of the skirt 121, there is a knob 124 for pulled by a finger, and there is a protrusion 125 at the central of the inside of the end portion 118. A gas emitting groove 126 is formed from one side of the protrusion 125 to the inner surface of the side wall portion 119.

As described above, the liquid cooling device 100 of the present invention is coupled to the mounting support 108 after the coolant gas was stored under high pressure into the coolant gas bottle 101 in state that a cap 203 of the container 200 is not coupled thereto. The mounting support 108 is firmly mounted on a bottom portion 201 of the container 200. In state that the male screw portion 113 of the mounting support 108 is firmly coupled to the female screw portion 120 of the cap 117, the liquid is poured into the container 200 and the cap 203 is closed. Those are all of the assembling procedures.

That is, as shown in FIG. 1, the liquid cooling device 100 is fixed to the bending portion 202 of the bottom portion 201 and inserted into the annular coupling groove 109 of the mounting support 108. The annular groove 110 is inserted into the end of the bending portion 202 thereby strictly fixing the liquid cooling device 100. The female screw portion 120 of the cap 117 is coupled to the male screw portion 113 of the mounting support 108.

Figure 2:
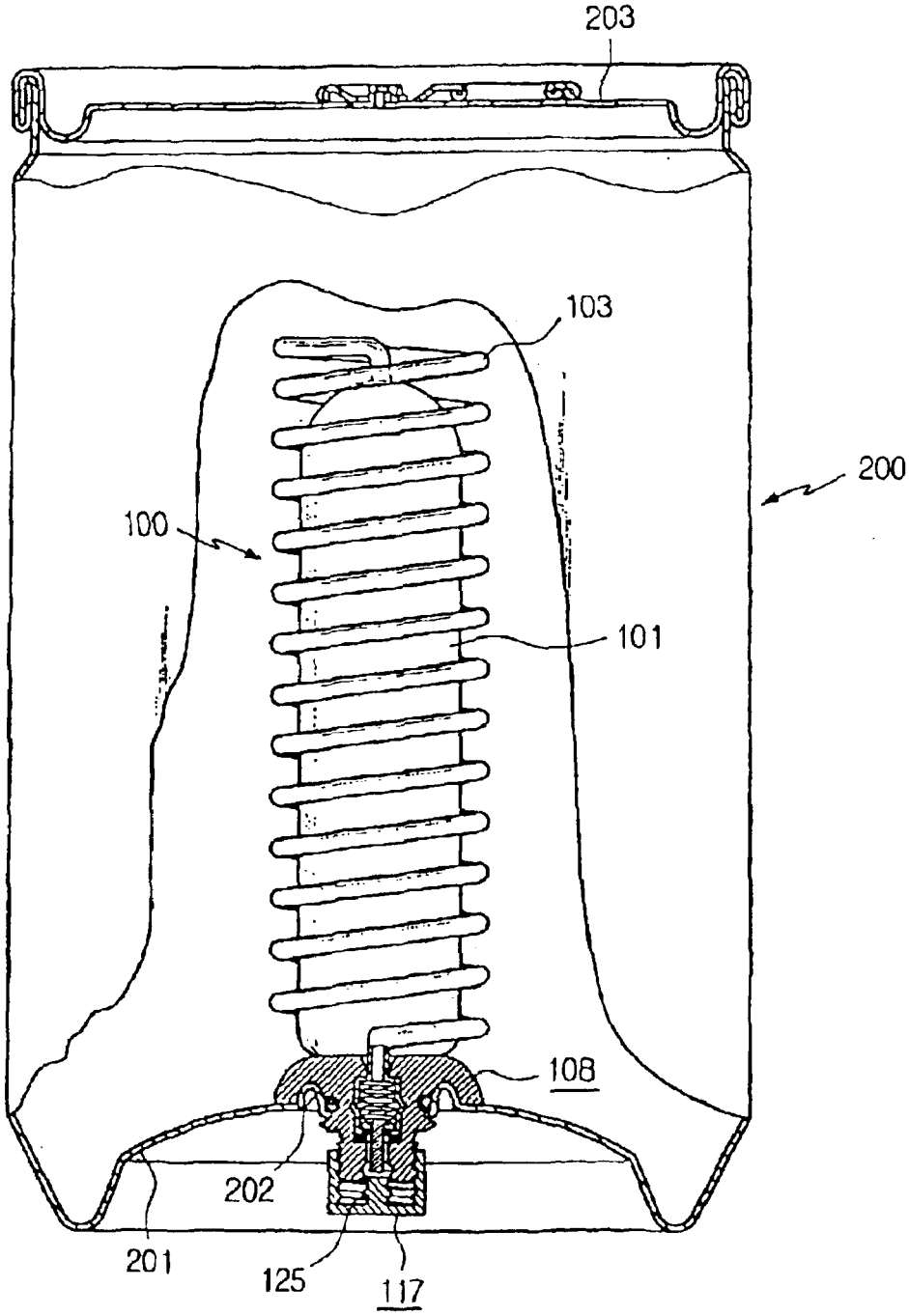
FIG. 2 is a partly sectional view of the self-cooling liquid container where a skirt is terminated from a cap.

As shown in FIG. 2, in the case of cooling the beverage of the container 200, when the knob 124 of the cap 117 is pulled by a finger, the separating guide line cuts and the skirt 121 is separated from the cap 117.

Figure 3:
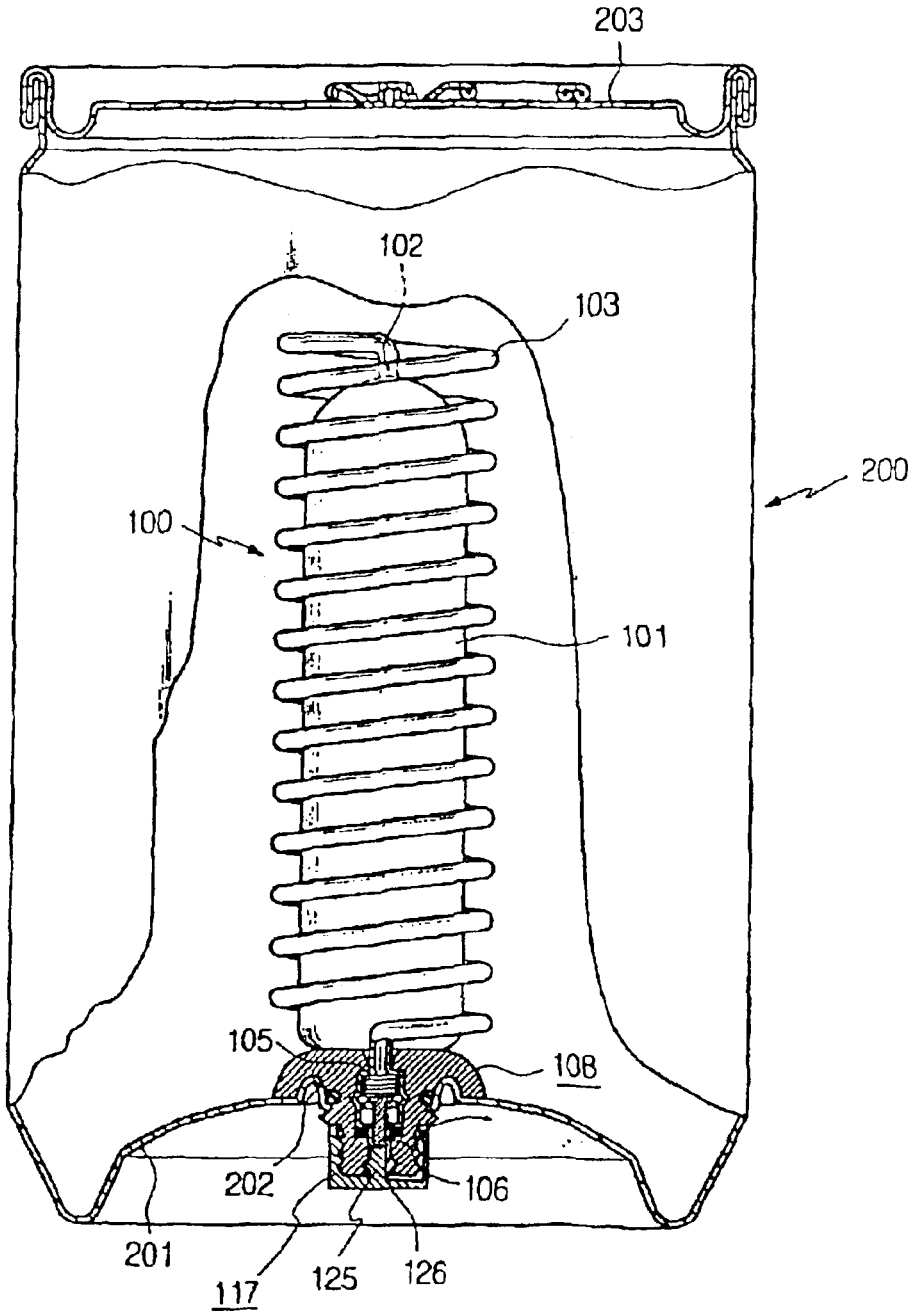
FIG. 3 is a partly section view of the self-cooling liquid container where the cap is rotated in an operating position of a cooling device.
Figure 4:
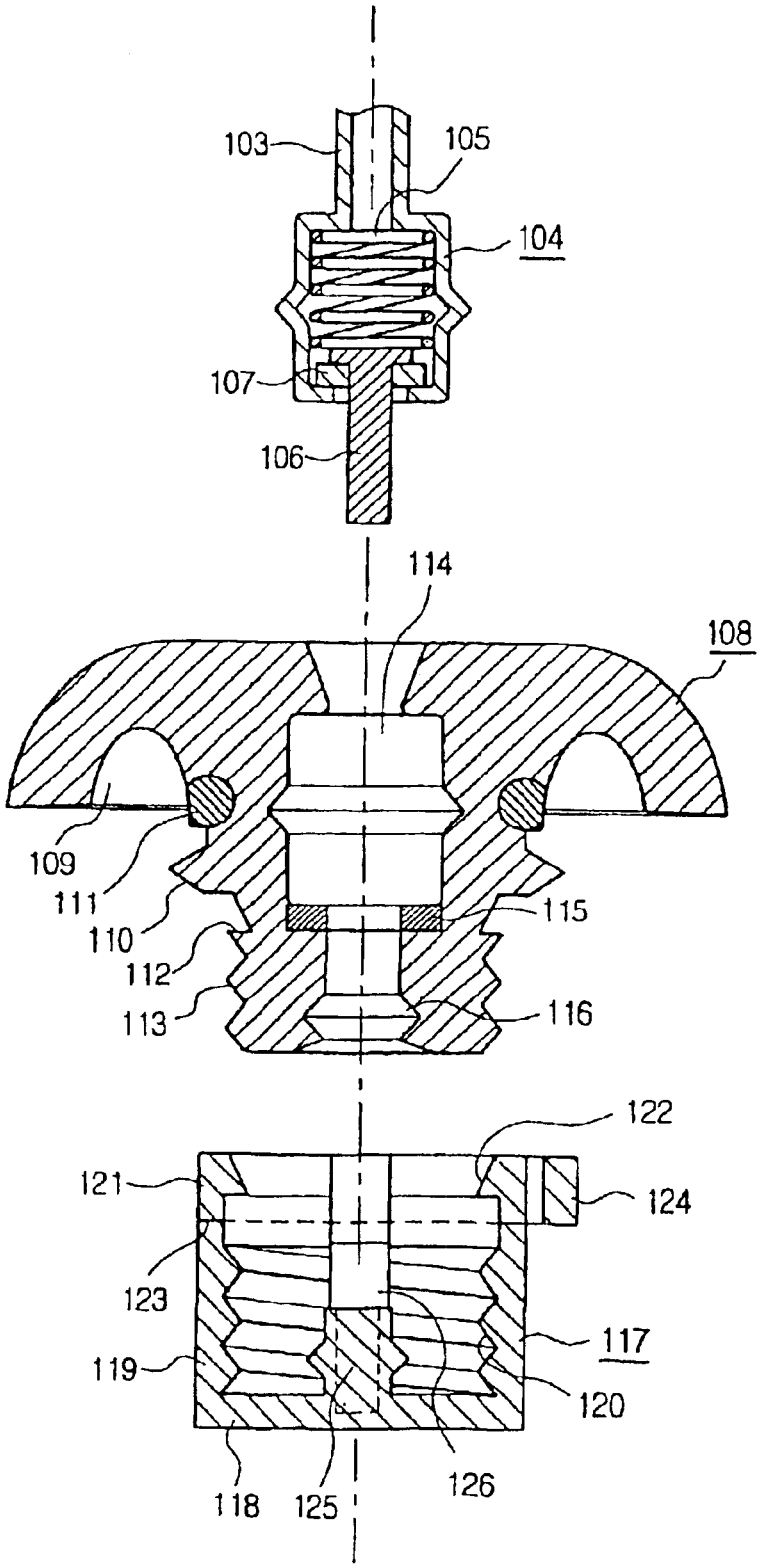
FIG. 4 is a sectional view of a liquid cooling device of the self-cooling liquid container of the present invention.
Figure 5:
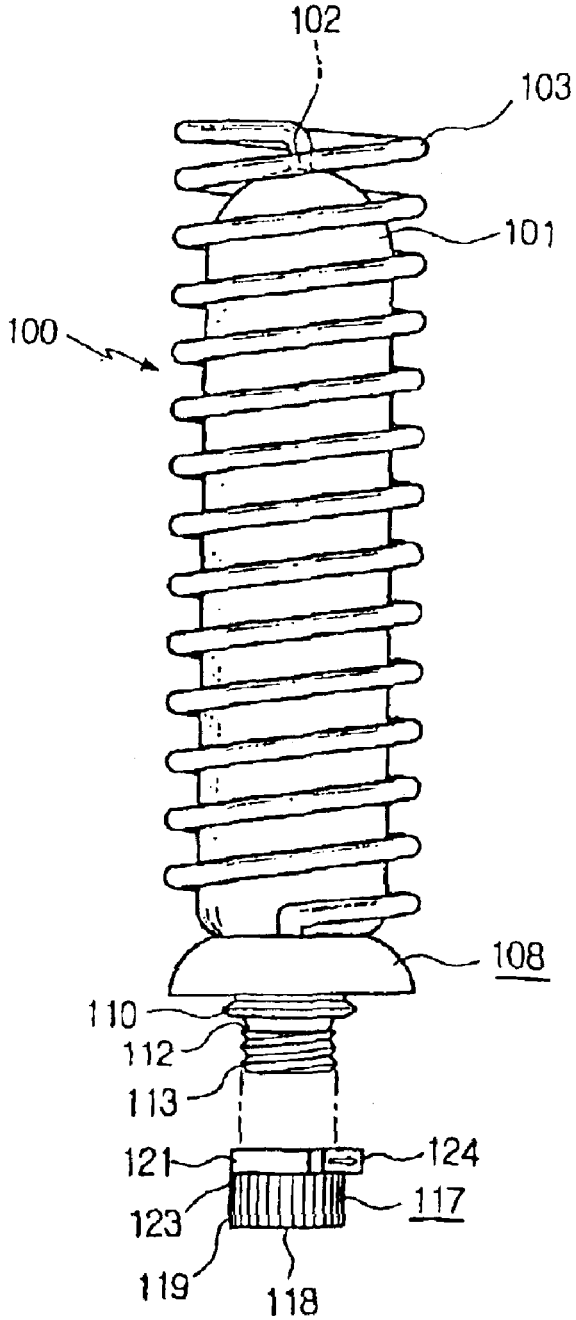
FIG. 5 is a side view of the liquid cooling device of the self-cooling liquid container of the present invention.

Referring to FIG. 3, when the cap 117 is rotated in an opening direction, the cap 117 is upwardly moved owing to a unification of the male and female screw portions and the upper surface of the protrusion 125 contacts the bottom of the switching protrusion 106. Then, the switching protrusion 106 presses the spring 105 so that the packing 107 is released and the switching portion 104 is open.

When the switching portion 104 is open, the coolant gas contained in the coolant gas bottle 101 is evaporated through the nozzle portion 102 and the nozzle tube 103.

Figure 6:
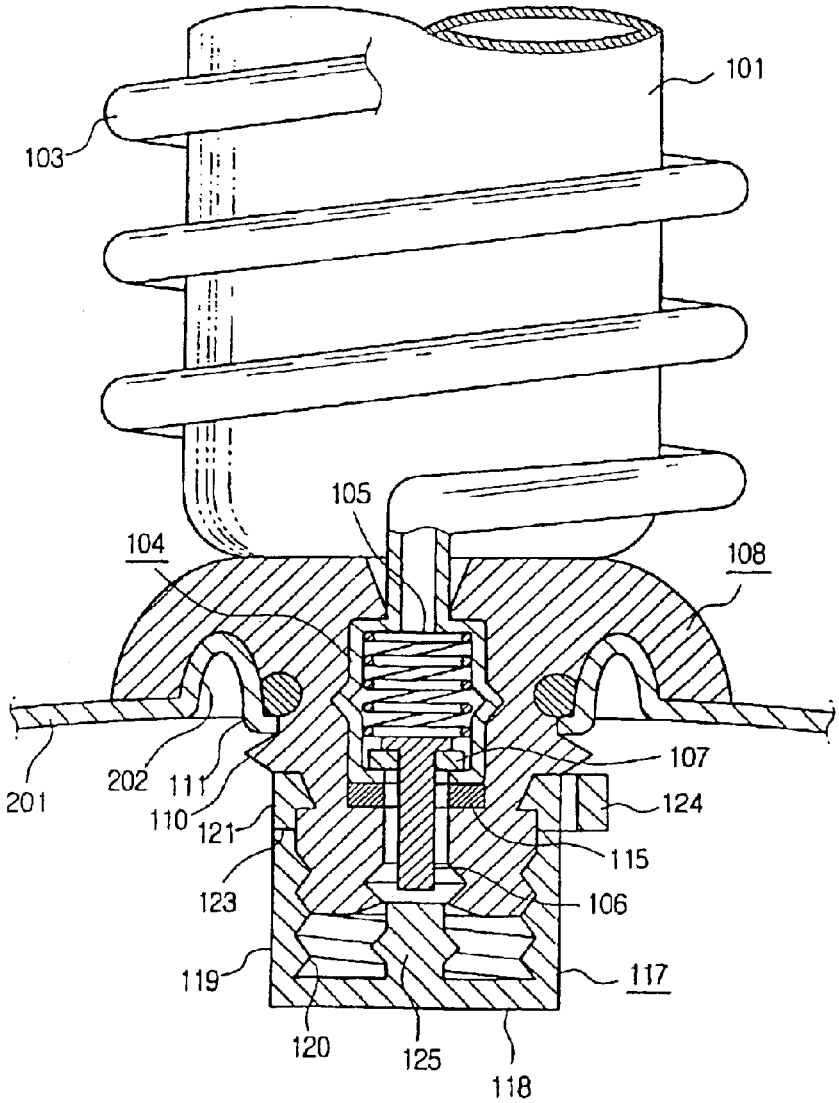
FIG. 6 is a partly enlarged view of the liquid cooling device of the self-cooling liquid container of the present invention.

Referring to FIG. 6, as the protrusion 125 upwardly moves and the ring formed at the periphery of the protrusion 125 and the bottom of the annular groove 116 of the mounting support 108, the cap 117 is temporarily resisted to move upwardly. In this state, the coolant gas is continuously emitted. This is the first step of cooling the liquid where the cooling time can be delayed.

Figure 7:
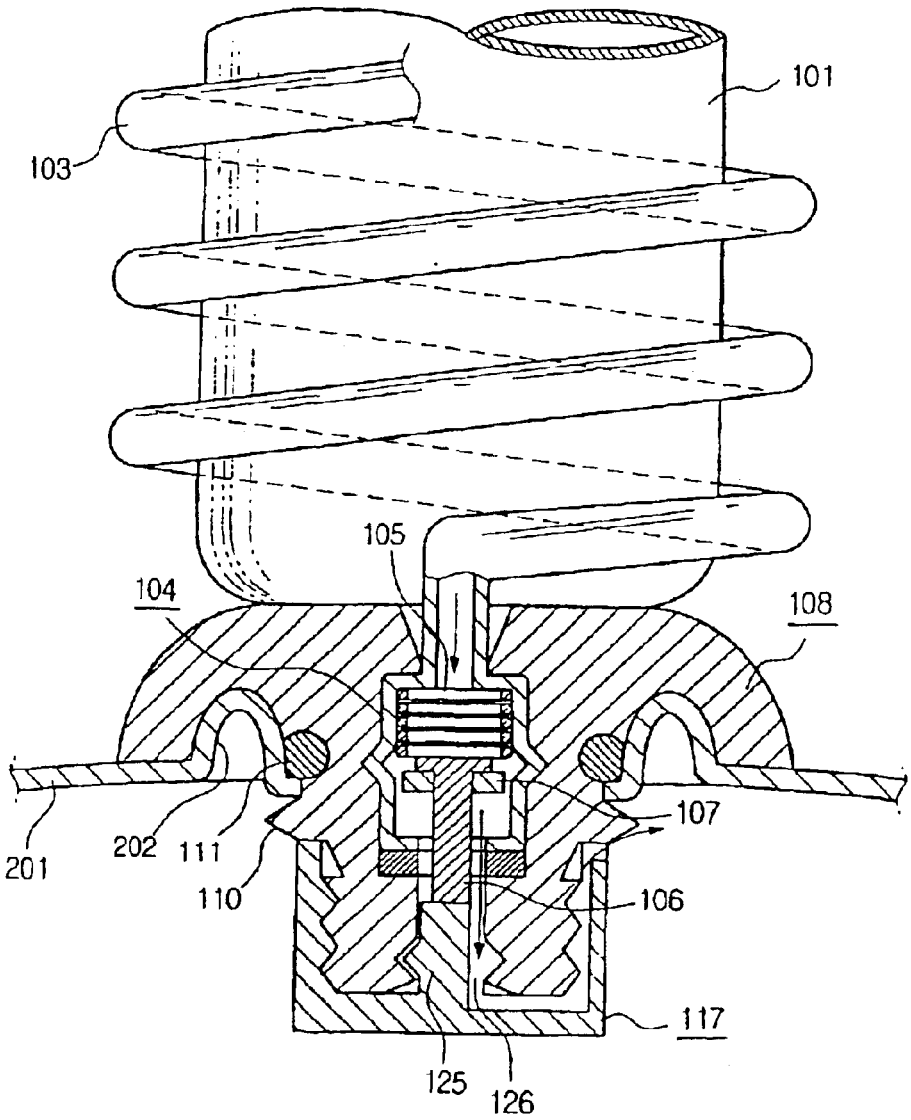
FIG. 7 is a partly enlarged view of the liquid cooling device mounted on the container of the present invention.

Further, as shown in FIGS. 3 and 7, when the cap 117 is further rotated, the periphery ring of the protrusion 125 is inserted into the annular groove 116 over the bottom jaw of the annular groove 116 formed in the mounting support 108. At this point the coolant gas of the coolant gas bottle 101 is evaporated through the nozzle portion 102 and the nozzle tube 103 thereby accomplishing the heat exchange, and then the gas is emitted through a gas emitting groove 126.

The control of the degree of liquid cooling is accomplished in below procedures. As the cap 117 rotates in an closing direction, the cap 117 moves downwardly and the switching protrusion 106 is closed by the restituting force of the pressure of the coolant gas and the spring 105 so that the emitting of the coolant gas stored in the coolant gas bottle 101 is prevented.

As described above, the liquid cooling device 100 of the present invention, is designed such that the coolant gas bottle 101 and the nozzle tube is helically formed to increase the contact surface with the liquid thereby increasing the cooling efficiency and reducing the coolant gas bottle 101.

Figure 8:
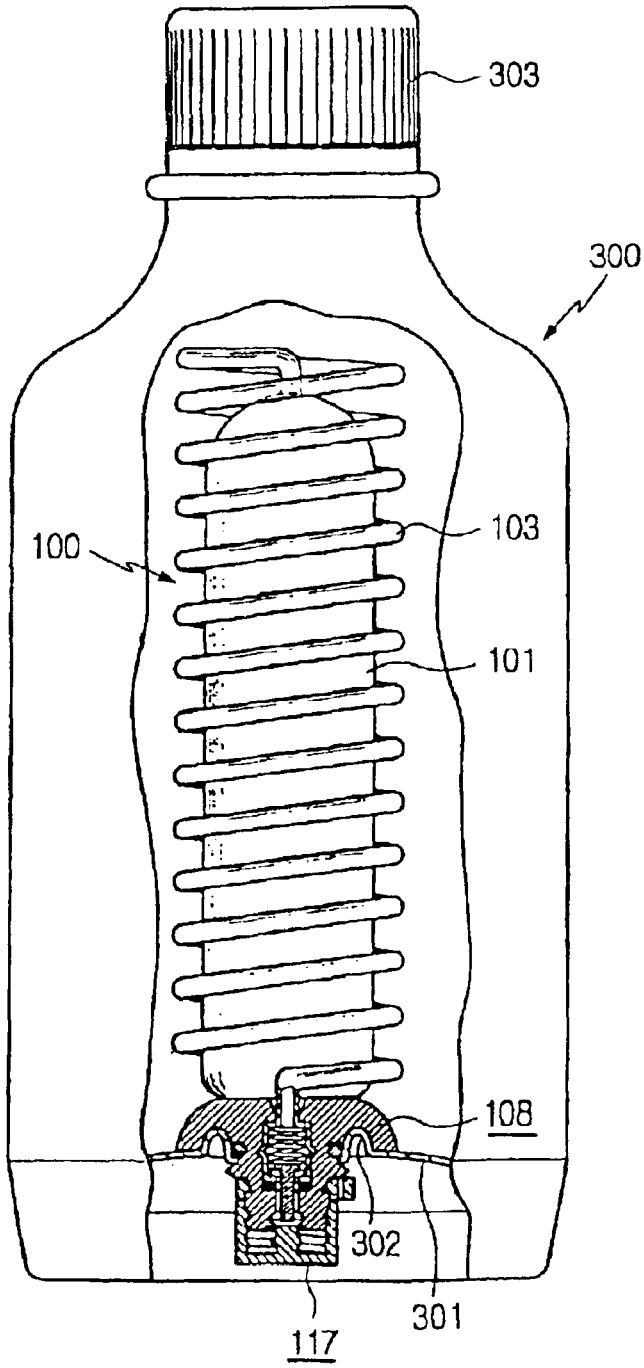
FIG. 8 is a partly sectional view of the self-cooling liquid container according to another embodiment of the present invention where the liquid cooling device is applied to a bottle.

Further, it is possible to apply the liquid cooling device 100 to a can and a bottle, as shown in FIG. 8, such that a hole is formed on the bottom portion 301 of the bottle 300 and the mounting support 108 is coupled to the bending coupling portion 302.

Figure 9:
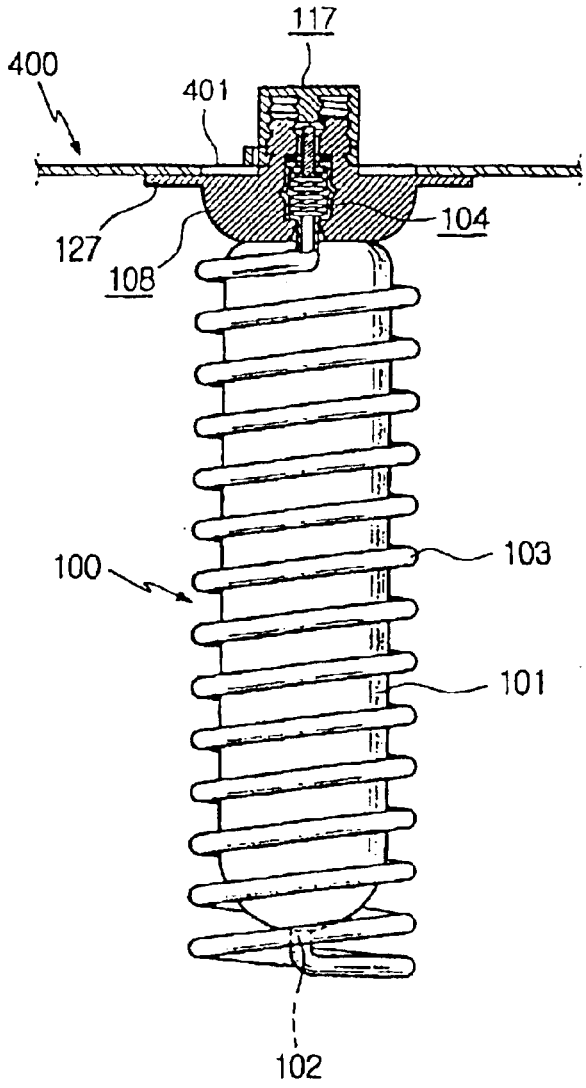
FIG. 9 is a partly sectional view of the self-cooling liquid container according to still another embodiment of the present invention where the liquid cooling device is applied to a thin-film container.

In another embodiment of the present invention, the liquid cooling device 100 of the invention, as shown in FIG. 9, is mounted to a flexible container 400 of paper, synthetic resins and pouch such that a punching hole 401 is formed on a surface of the flexible container 400 and an adhesive surface 127 of the mounting support 108 sticks to a top of bottom surface of the punching hole 401.

Figure 10:
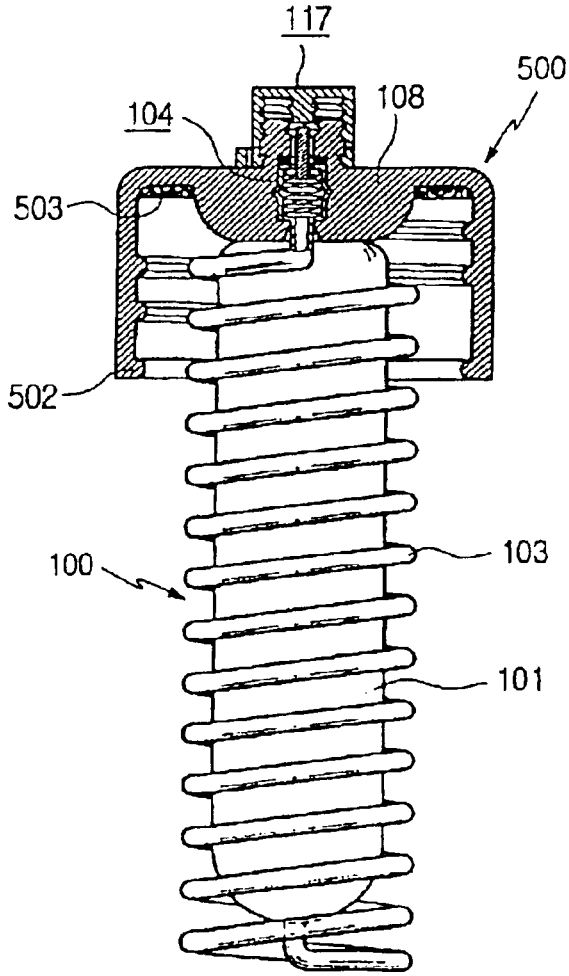
FIG. 10 is a partly sectional view of the self-cooling liquid container according to a still further embodiment of the present invention where the liquid cooling device is applied to a bottle cap.

FIG. 10 shows still another embodiment of the present invention. The liquid cooling device 100 is mounted on a bottle neck. The mounting support 108 is designed to be a bottle cap 500. The inner surface of the cap 500 is formed with a screw thread 501, the bottom of the cap 500 is formed with a opening identification skirt 502 and a packing 503 is inserted into the upper inner surface of the cap 500.

Figure 11:
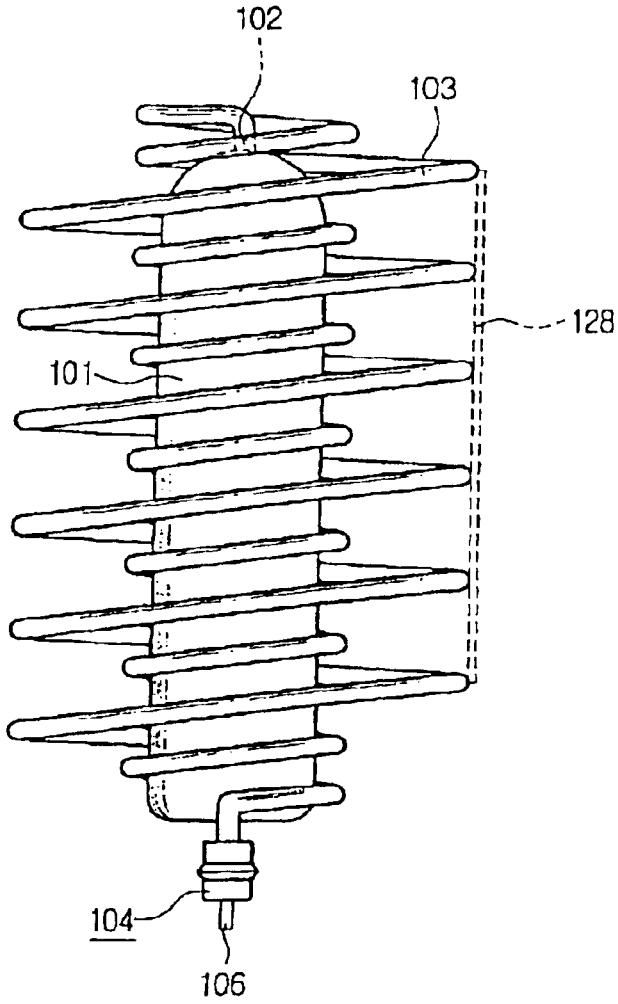
FIG. 11 is a side view of a nozzle tube according to another embodiment of the present invention.

FIG. 11 shows a still further embodiment of the present invention; The liquid cooling device 100 is designed such that the nozzle tube 103 is helically rounded around the coolant gas bottle 101 and the rounding diameter is irregular. These increase the contact surface.

A reinforcement 128 is provided around the nozzle tube 103 thereby preventing its deformation owing to a coolant gas flow.

Figure 12:
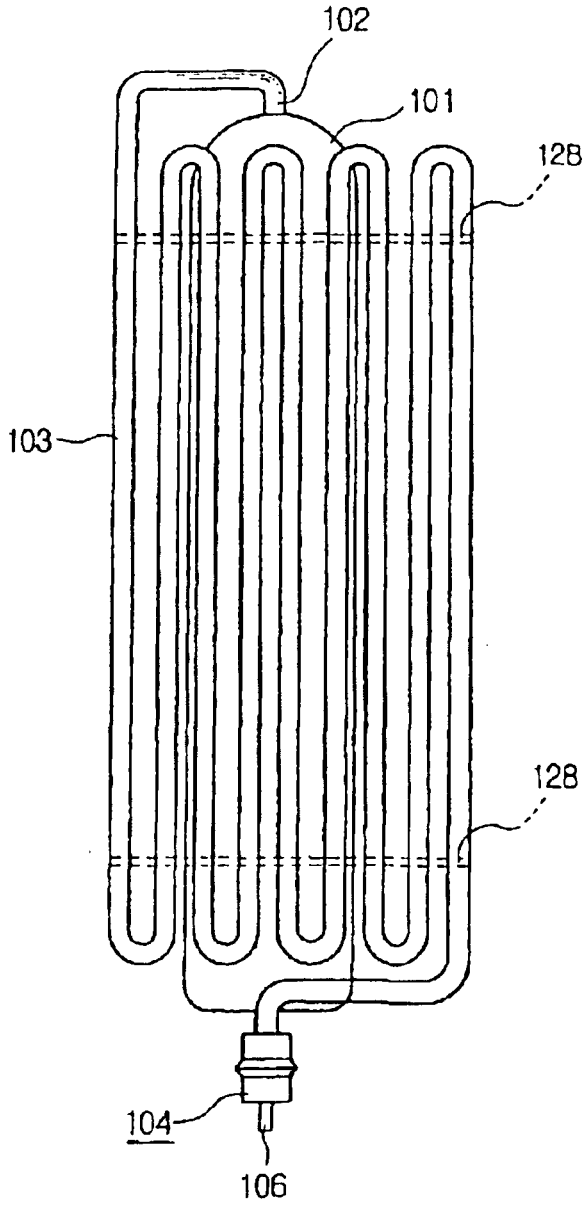
FIG. 12 is a side view of a nozzle tube according to still another embodiment of the present invention.

In another embodiment of the present invention, the liquid cooling device 100 of the present invention is designed such that the nozzle tube 103 is longitudinally mounted in the container shown in FIG. 12. In this case, both ends of the nozzle tube 103 is bent and connected to the nozzle portion 102 and the switching portion 104. The reinforcement 128 is provided to the upper and bottom portion of the nozzle portion 102 for preventing the deformation owing to a coolant gas pressure.

Figure 13:
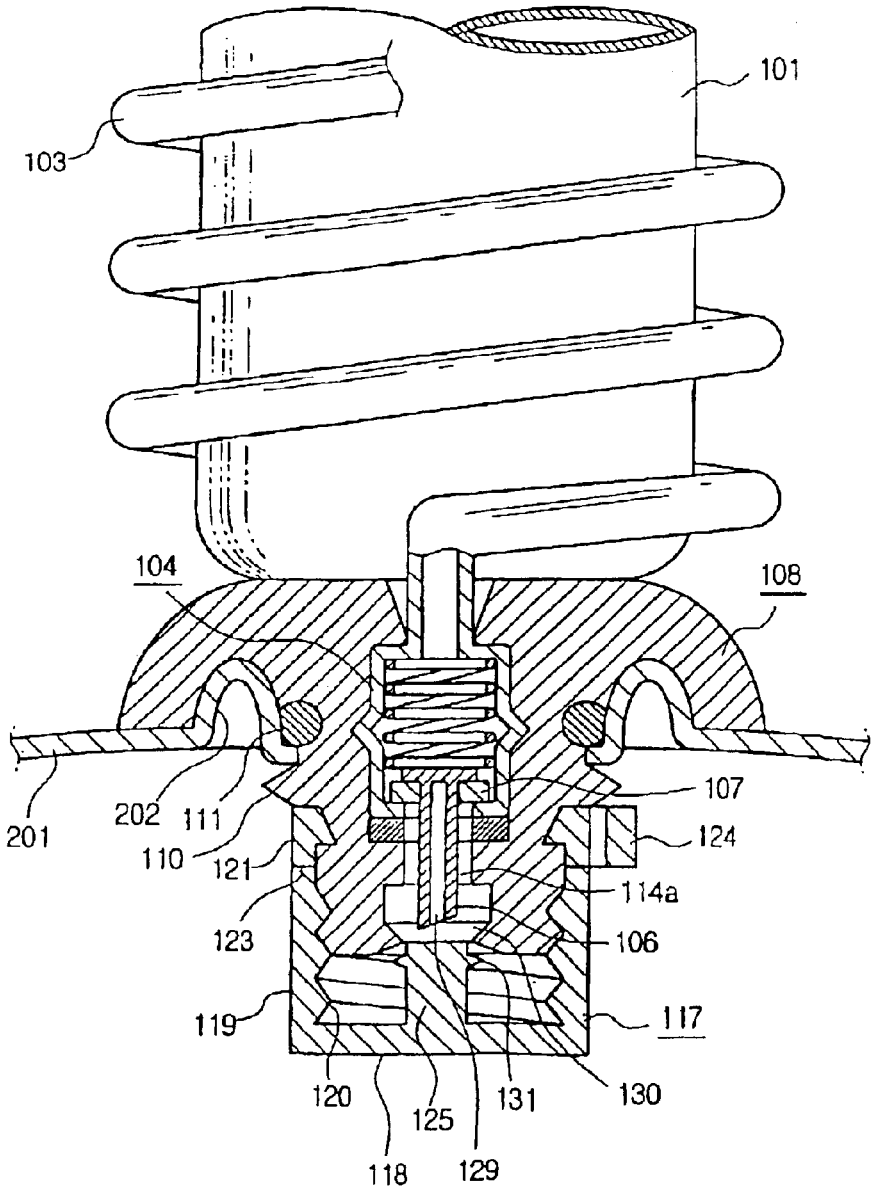
FIG. 13 is a partly sectional view of a mounting support and a cap according to another embodiment of the present invention.

Referring to FIG. 13, the liquid cooling device 100 is designed such that a coolant gas emitting hole 129 is formed inside the switching protrusion 106 and the coolant gas emitting hole 129 communicates with a gas emitting hole 126 formed at a upper side of the switching protrusion 106.

Further, the bottom of the gas emitting hole 129 inclines, a space portion 130 is formed in a bottom of a hole 114*a* corresponding to the end of the hole 126, and a ring 131 is protruded at the periphery of the protrusion 125 of the cap 117.

Figure 14:
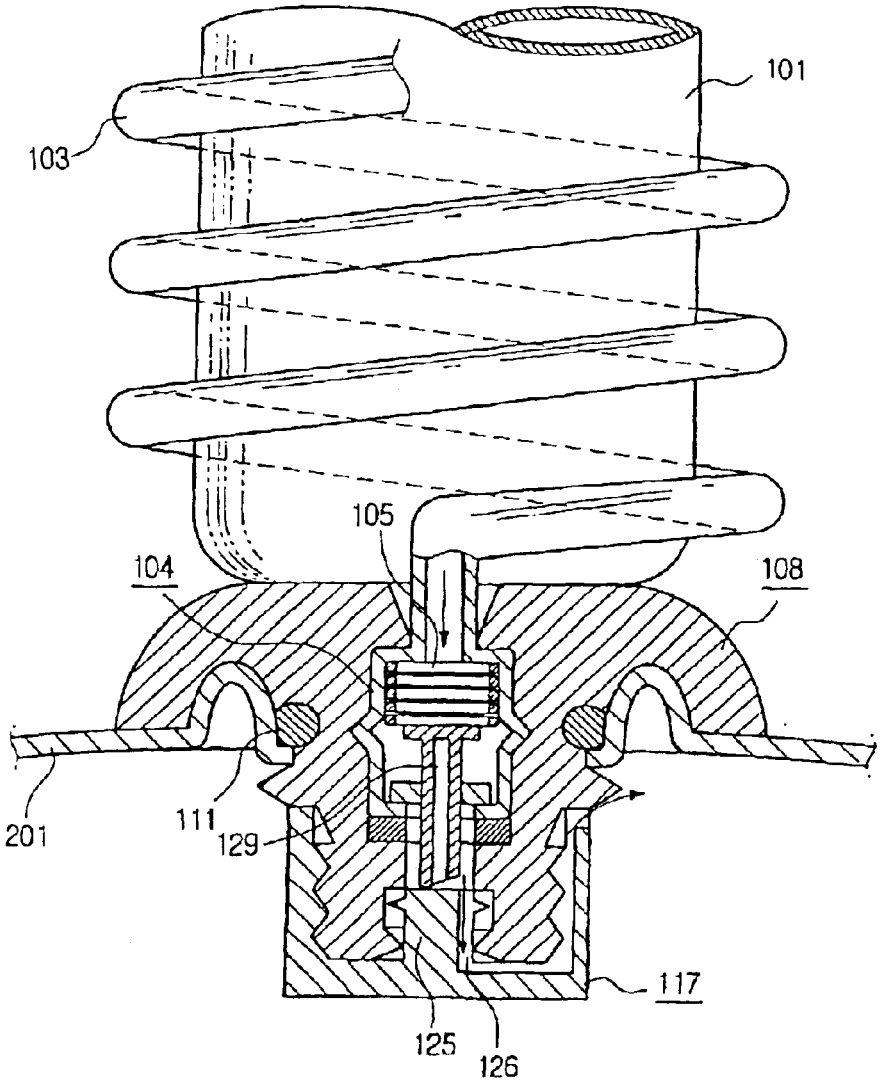
FIG. 14 is a view substantially as in FIG. 13 where the mounting support and the cap are in an operating position.

In this embodiment, as shown in FIG. 14, after the skirt 121 is removed by pulling the knob 124 of the cap 117, the cap 117 rotates clockwiese and the protrusion 125 pushes the bottom end of the switching protrusion 106 so that the switching portion 104 is in an opening state. Simultaneously, the coolant gas contained in the coolant gas bottle 101 is evaporated through the switching protrusion 106, the gas emitting hole 129 and the gas emitting hole 126 formed in the cap 117 via the nozzle portion 102 and the nozzle tube 103.

Further, it is possible to control the temperature of the liquid by controlling the volume of the evaporated coolant gas according to the regulation of the cap 117.

The knob 131 around the protrusion 125 further functions as a safety device preventing the cap 117 from being separated by the pressure of the coolant gas. When children use the cap 117, the knob 131 hooks at the bottom jaw of a space portion 130 so that the cap 117 can not be easily pulled up.

Figure 15:
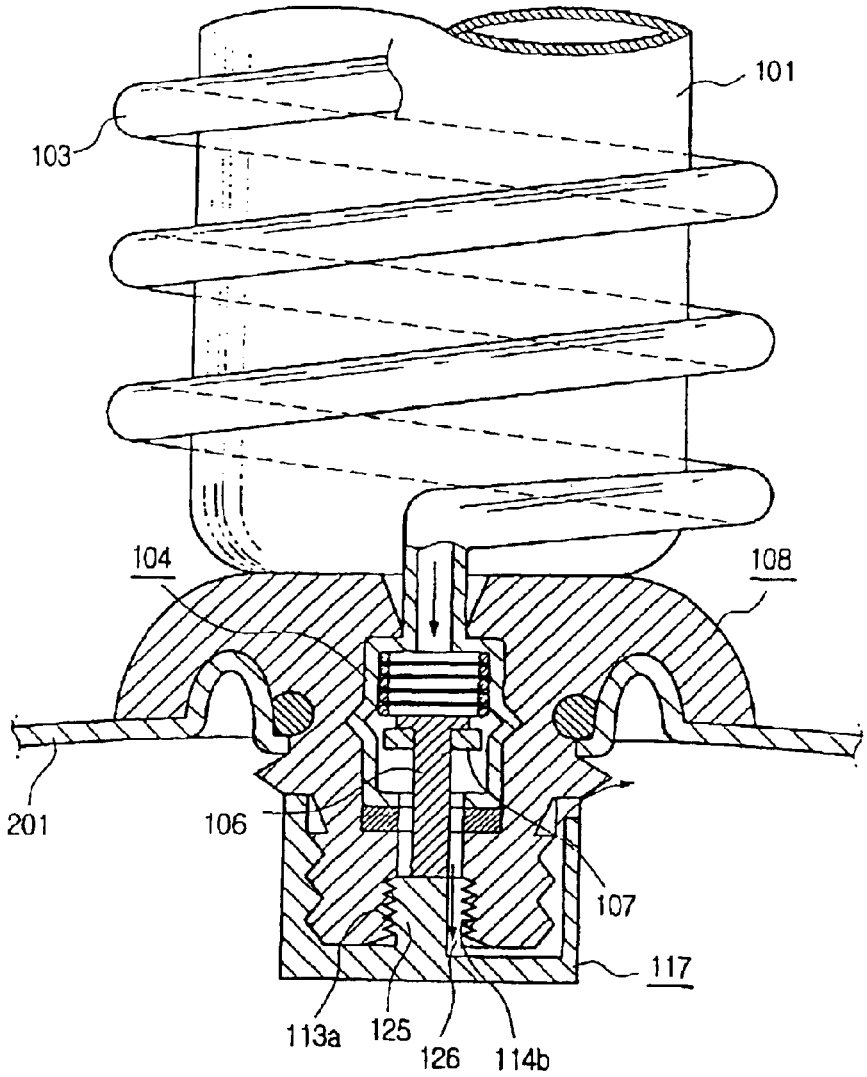
FIG. 15 is a partly sectional view of a mounting support and a cap according to still another embodiment of the present invention.

In another embodiment, as shown in FIG. 15, the liquid cooling device 100 is formed with a threaded portion 113*a* at the periphery of the protrusion 125 and a corresponding threaded portion 114*b* is formed at the inside of a hole 114*a* of the mounting support 108, whereby the switching protrusion 106 is efficiently pushed up and further the cap 117 is prevented from separating by the emitting gas pressure in the course of cooling the liquid.

Figure 16:
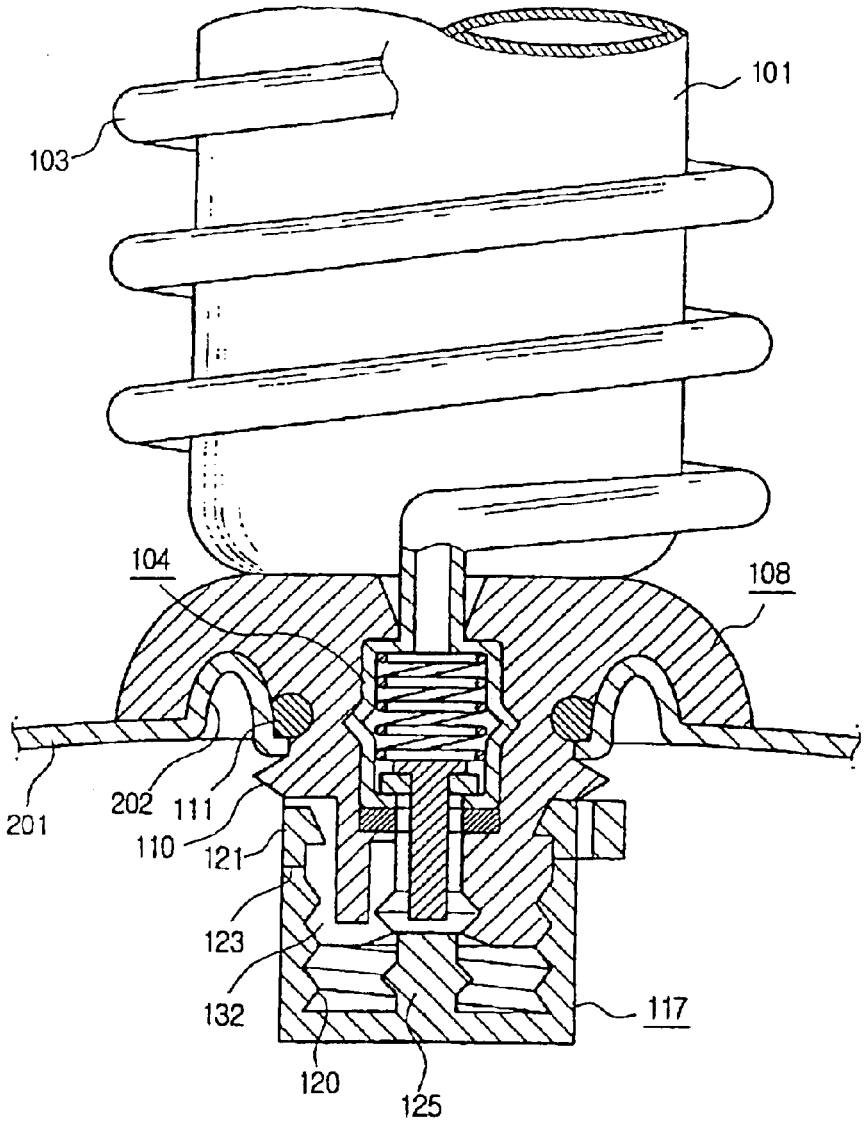
FIG. 16 is a view substantially as in FIG. 15 where the mounting support and the cap are coupled to the container.

In another embodiment of the present invention, the liquid cooling device 100 is not limited such that the gas emitting hole 126 is formed in the cap 117. As shown in FIG. 16, a gas emitting hole 132 is designed such that it communicates from the bottom end of the annular protrusion 110 of the mounting support 108 near to a position of inserting the packing 115.

Figure 17:
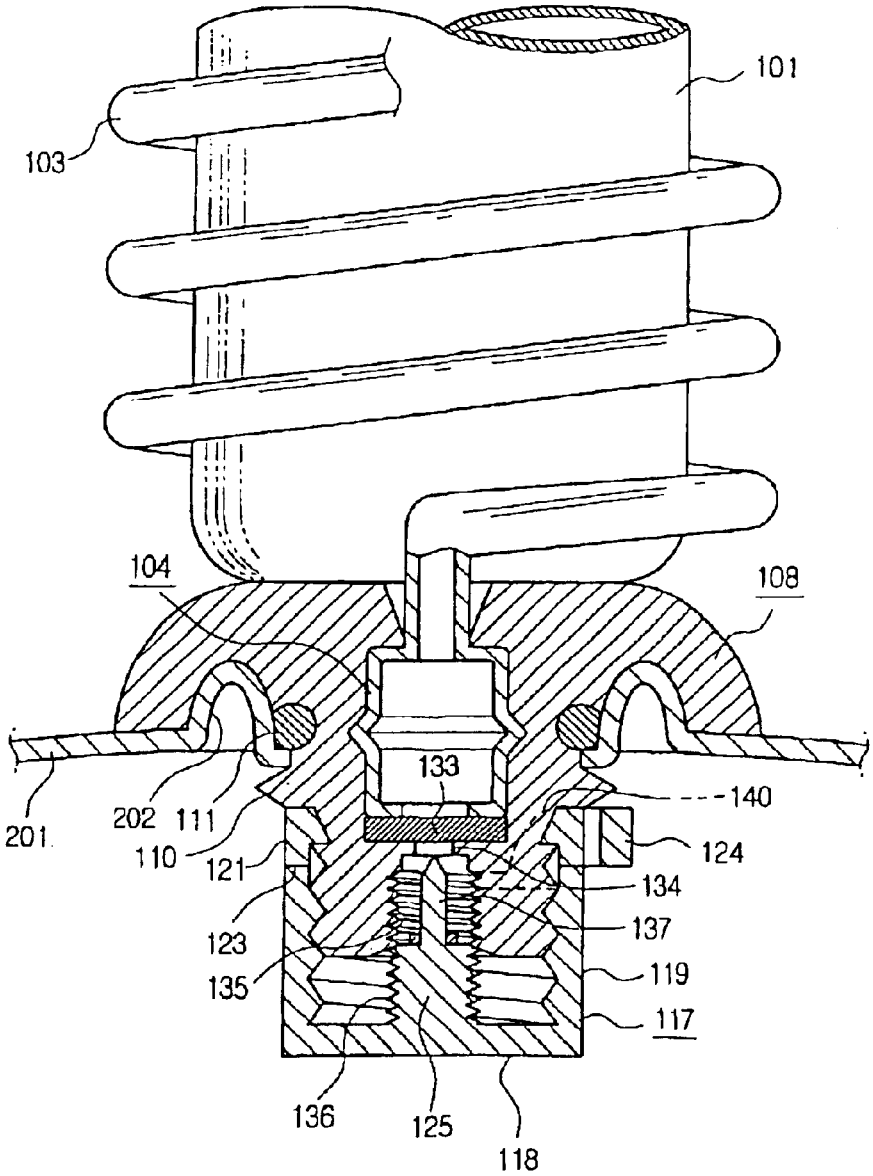
FIG. 17 is a partly sectional view where a mounting support and a cap according to a still further embodiment of the present invention are coupled to the container.
Figure 18:
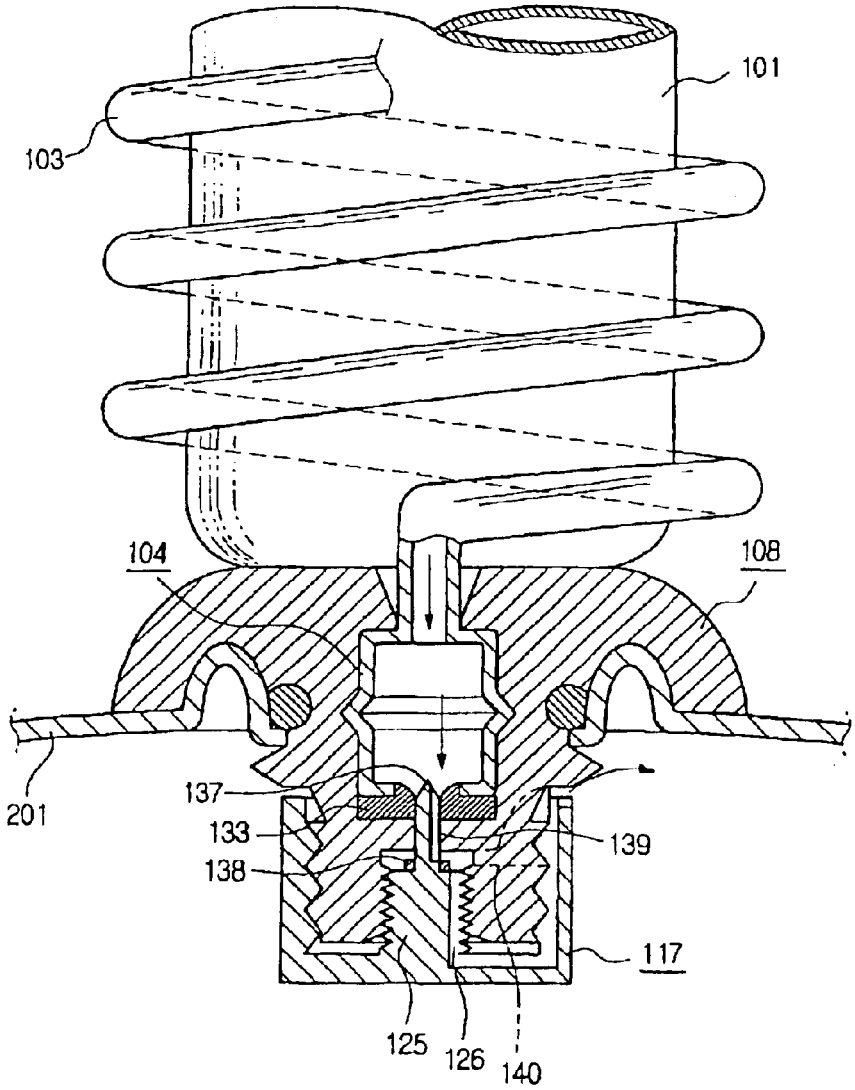
FIGS. 18 and 19 is a view substantially as in FIG. 17 where the mounting support and the cap are in an operating position.
Figure 19:
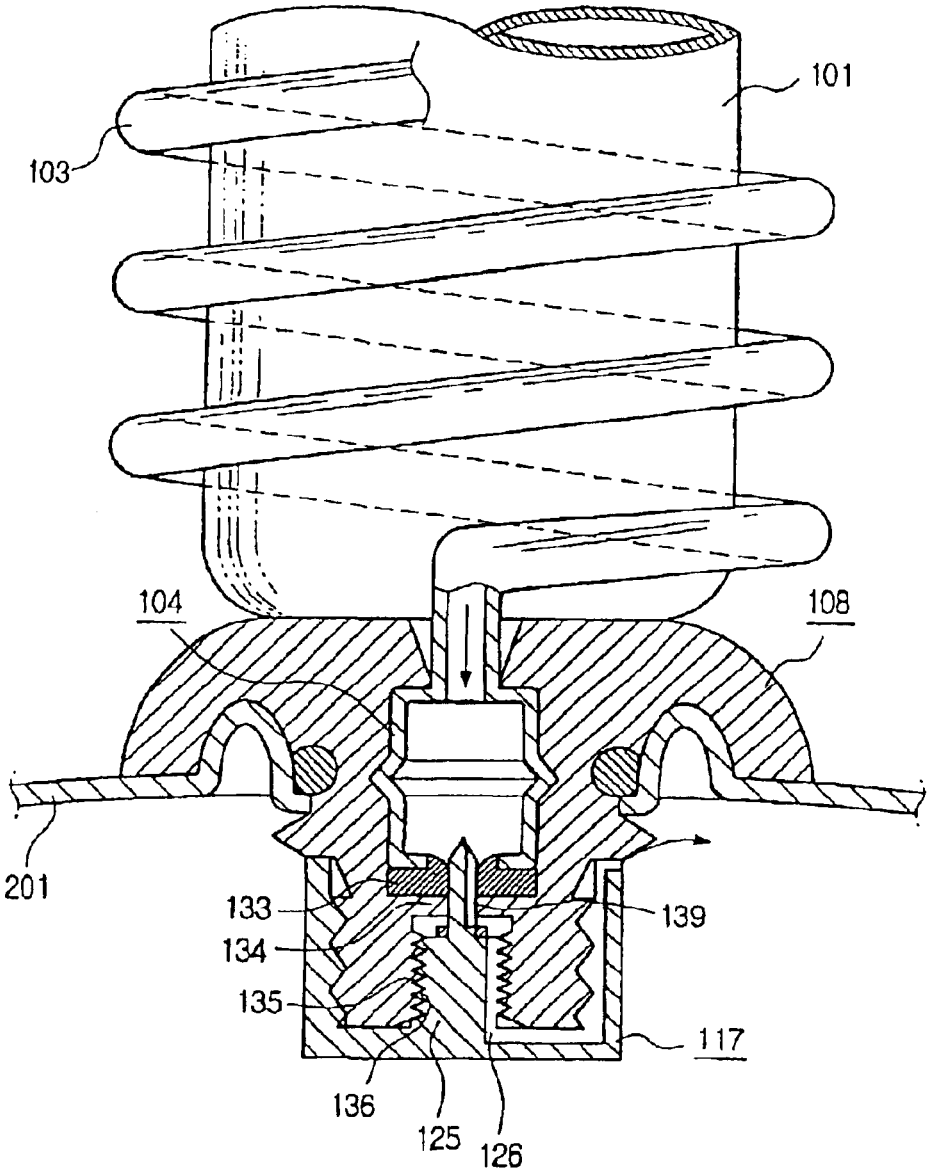

Referring to FIGS. 17 to 19, the liquid cooling device 100 is designed such that the switching portion 104 is inserted into the switching portion inserting groove 114 of the mounting support 108, a packing 133 is stuck to an end of the switching portion 104, a threaded portion 135 is formed at a lower side of an annular jaw 134 formed under the packing 133, and a switching protrusion 125 is formed at the cap 117 coupled to the mounting support 108.

Further, a threaded portion 136 is formed around the protrusion 125, a step-shaped protruding needle 137 is formed at an upper side of the protrusion 125, and a seal packing 138 is coupled to a lower step jaw portion of the protruding needle 137.

The gas emitting hole 126 communicates from the threaded portion 138 of the protrusion 125 to the outside thereof and a gas emitting hole 139 is formed at an outer wall of the protruding needle 137.

In this embodiment, as shown in FIG. 17, the knob 124 is pulled to separate the skirt 121 in state that the cap 117 is coupled to the bottom of the mounting support 108, and then the cap 117 is rotated clockwise for the protruding needle 137 to punch the packing 133 so that the switching portion 104 is open. At the same time, the coolant gas is evaporated through the nozzle portion 102 and the nozzle tube 103 thereby cooling the liquid. Arrows shown in FIG. 18 show a course of the coolant gas from the coolant gas bottle 101 to the gas emitting holes 126 and 139.

Further, the annular jaw 134 can be provided at its lower side with a coolant gas emitting hole 14 for smoothly emitting the gas.

Referring to FIG. 19, as the cap 117 is further rotated clockwise and tightens, the packing 134 contacts the bottom of the annular jaw 134 and the switching portion 104 is closed thereby stopping the emission of the coolant gas.

Therefore, it can be possible to control the amount of emitting coolant gas and the temperature of the liquid of the container 200 by controlling the degree of rotating/tightening of the cap 117.

In another embodiment of the present invention, as shown in FIGS. 20 to 24, the liquid cooling device 100 comprises a coolant gas bottle 600 which is mounted at the bottom of the container 200 and is integrally formed of coil-shaped coolant gas bottle 600 and a cap 700 which is coupled to the bottom of the coolant gas bottle 600.

Figure 20:
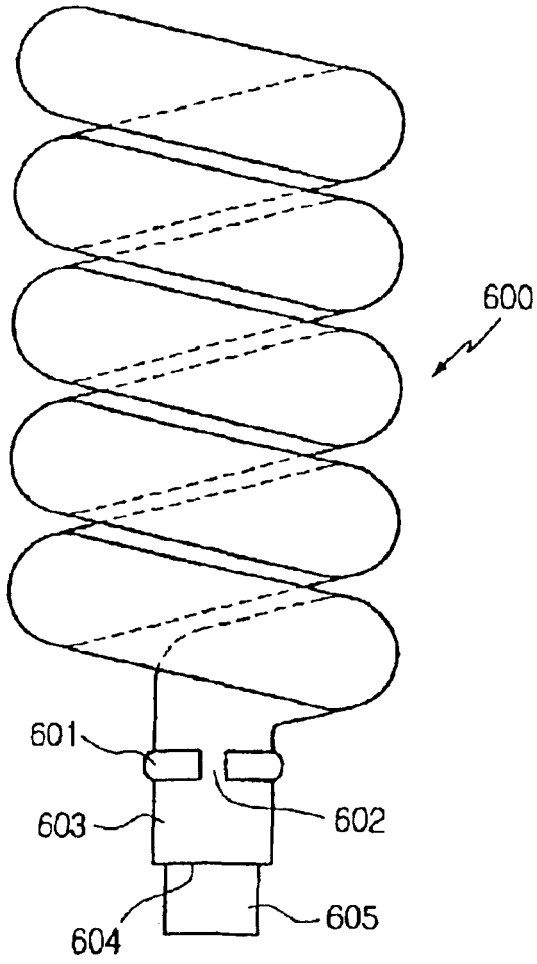
FIG. 20 is a side view of a coolant gas bottle according to an embodiment of the present invention.

Referring to FIG. 20, the coolant gas bottle 600 is designed such that its length proportions with a volume of the container 200 and is formed with a nozzle portion 602 within a pressing portion 602.

A diffusing tube 603 is formed at a lower side of the nozzle portion 602 and a coupling portion 605 having a step jaw 604 is formed at a bottom end of the diffusing tube 603.

Figure 22:
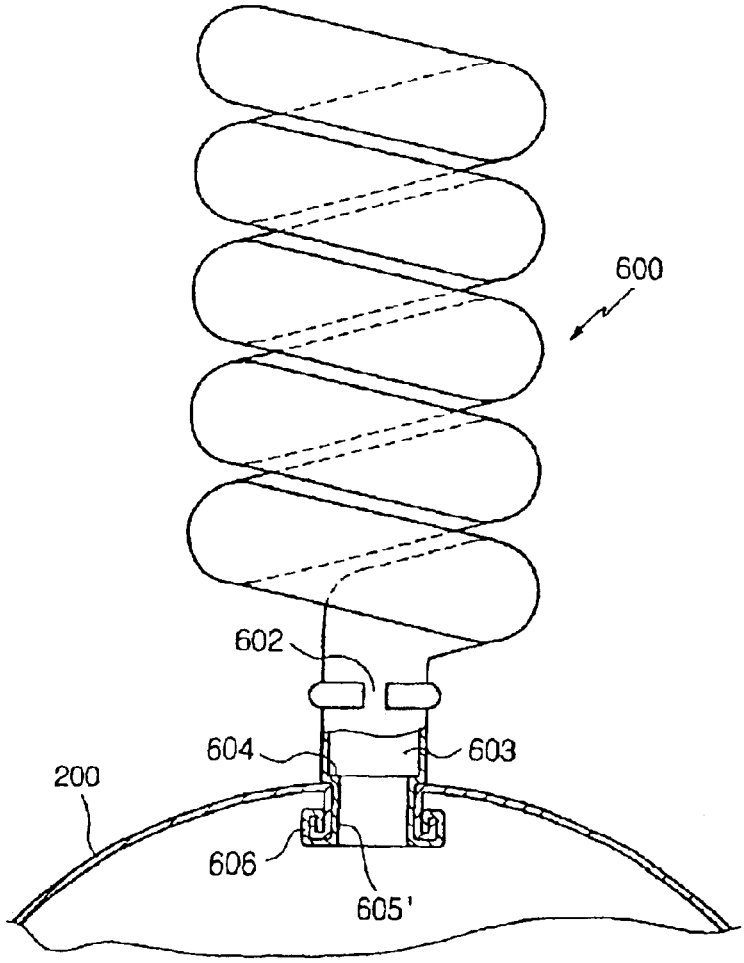
FIG. 22 is a partly cut-away sectional view where the coolant gas bottle is coupled to the container.

Referring to FIG. 22, the coolant gas bottle 600 is coupled to the bottom portion 201 of the container 200 and the coupling portion 605 of the coolant gas bottle 600 is sealed with the bottom portion 201 thereby making a sealed portion 606.

Figure 21:
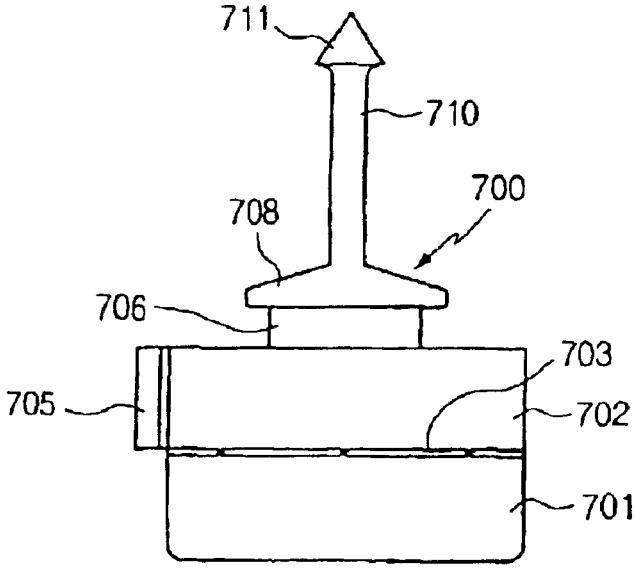
FIG. 21 is a side view of a cap according to an embodiment of the present invention.

As shown in FIG. 21, the cap 700 coupled to the coupling portion 605 is divided into upper and bottom side portions 701 and 702 by a separating guide line 703, an engagement jaw 704 is formed in an inner side of the upper side portion 701 and an knob 705 is formed at the bottom side portion 702 for terminating the bottom side portion from the upper side portion 701.

The cap 700 is designed such that the sealing portion 706 is formed with an annular band 708, a coolant gas emitting groove 707 is extended to the engagement jaw 704 and the coolant gas emitting groove 707 spaces from the annular band 708.

Further, there is a coolant gas emitting groove 709 at the outside of the annular band 708. A central portion of the annular band 708 is provided with a seal stick 710 formed at its upper end with a seal protrusion 711. The seal stick 710 is provided with a coolant gas emitting groove 712 spaced from the seal protrusion 711.

Figure 23:
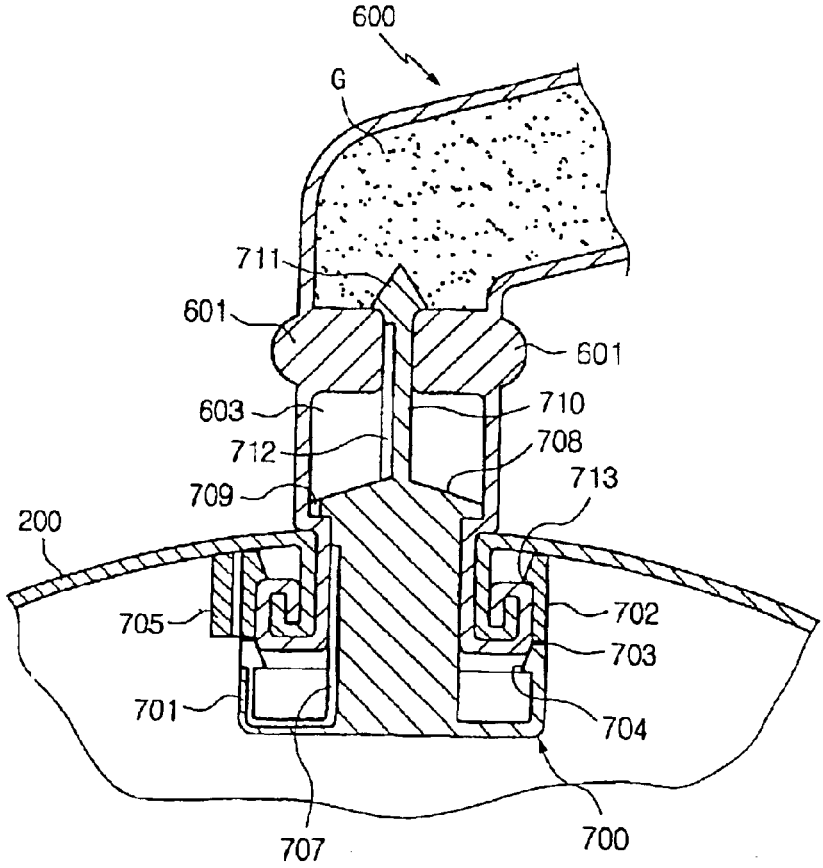
FIG. 23 is a partly enlarged sectional view where the coolant gas bottle and the cap are coupled.

FIG. 23 is a partly enlarged sectional view where the coolant gas bottle 600 and the cap 700 are coupled as described above. The cap 700 coupled to the bottom of the coolant gas bottle 600 is designed such that its seal protrusion 711 is coupled to the upper end of the nozzle portion 602 through a hole of the nozzle portion 602 thereby maintaining the sealed state. The annular band 708 is flexibly passed through an inner wall 605' and is fixed to the step jaw 604, and the seal portion 706 is sealed with the inner wall 605'. At this point, the engagement jaw 713 of the cap 700 is engaged with the sealed portion 606 and fixed thereto.

Referring to FIG. 23, when the knob 705 is pulled in state that the cap 700 is coupled to the bottom of the coolant gas bottle 600, a lateral separating guide line (not shown) and the separating guide line 703 are separated thereby terminating the bottom side portion 702.

Figure 24:
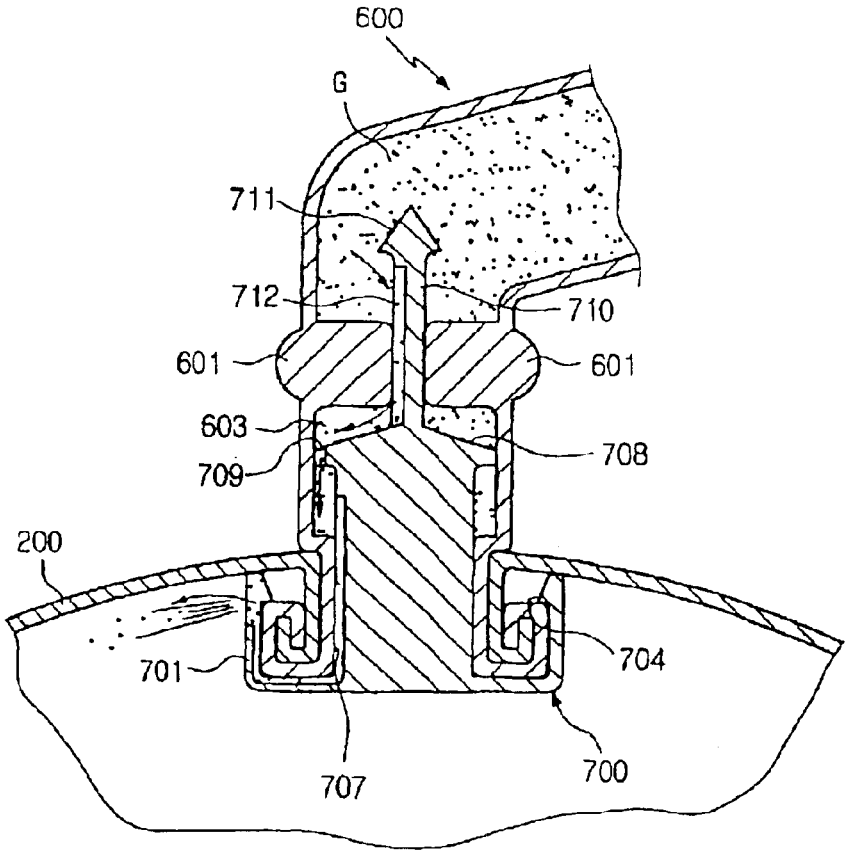
FIG. 24 is a partly enlarged sectional view where the cap is in an operating position.

In this state, pressing the cap 700, the cap 700 upwardly moves as shown in FIG. 24. As a result, the coolant gas emitting holes 707, 709 and 712 is open, the coolant gas G contained in the coolant gas bottle 600 flows into the diffusing tube 603 through the coolant gas emitting groove 712 and is evaporated. At the same time, the evaporated gas G is emitted out through coolant gas emitting grooves 707 and 709.

As the coolant gas bottle 600 is shaped of a coil, the contact surface between the liquid and coolant gas bottle 600 increases and complies an effective heat transmission. Especially, the coolant gas bottle 600 is integrally formed so that it can be possible to maintain a perfect sealing.

In still another embodiment of the present invention, the liquid cooling device 100 is designed such that the coolant gas bottle is shaped of a coil and is able to be longitudinally folded.

Figure 25:
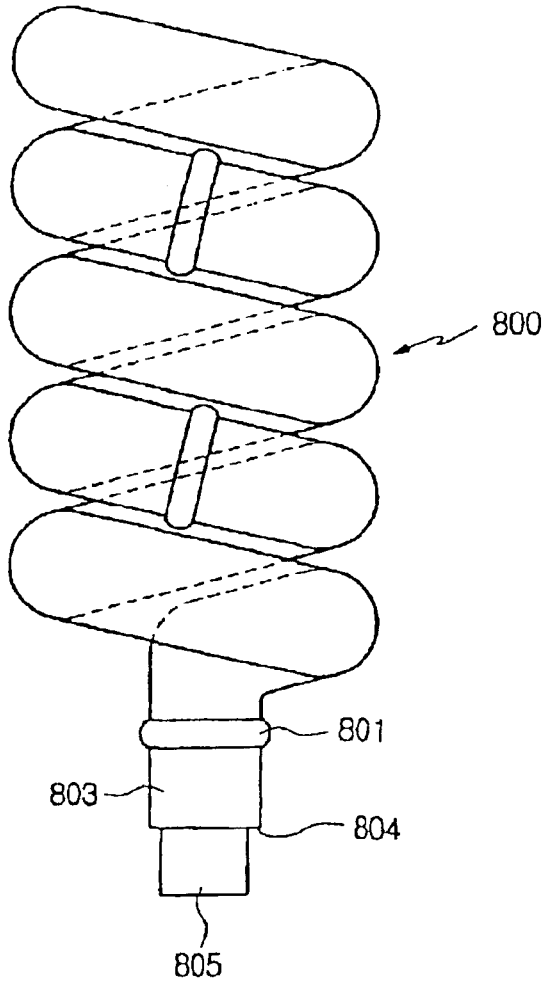
FIG. 25 is a side view of a coolant gas bottle according to an embodiment of the present invention.
Figure 26:
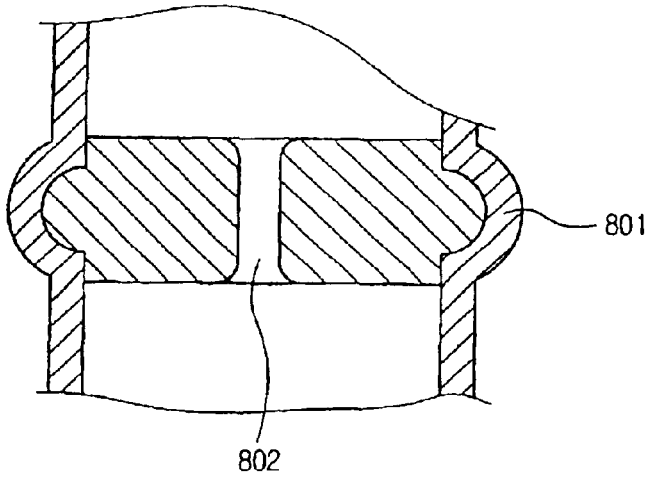
FIG. 26 is a partly cut-away sectional view showing a sealing portion.

FIGS. 25 and 26 shows another embodiment of the present invention. The liquid cooling device 100 is designed such that a pressing portion 801, a diffusing nozzle 803 and a coupling portion 805 having a step jaw 804 are formed in order at a lower side of a coolant gas bottle 800, and the coolant gas bottle is provided with plural pressing portions 801

As shown in FIG. 26, the pressing portions 801 is independently formed with the nozzle portion 802 and inserted therewith.

The coolant gas bottle 800 of the embodiment is designed such that the coolant gas is firstly evaporated and diffused through the nozzle portion 802 of the pressing portion 801 and then secondly and thirdly evaporated and diffused through each below nozzle portion 802 thereby improving a cooling effect.

Figure 27:
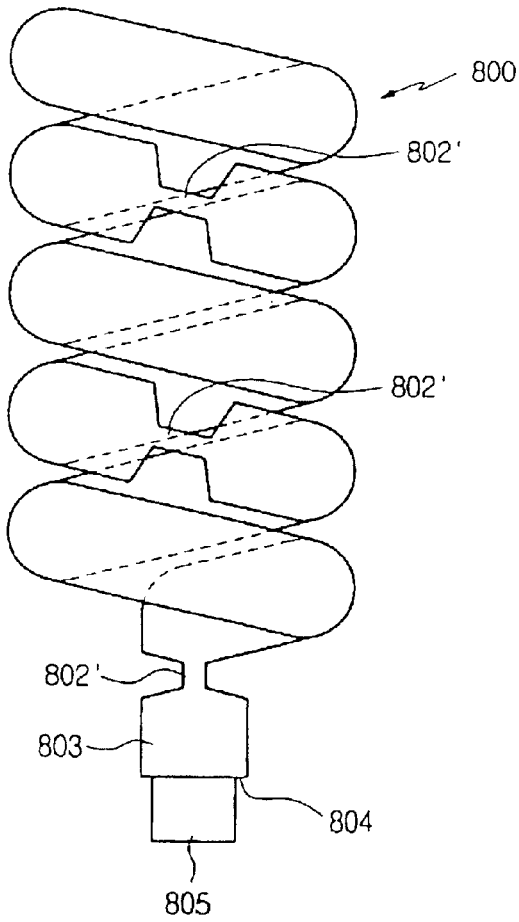
FIG. 27 is a side view of a coolant gas bottle according to an embodiment of the present invention.

FIG. 27 shows another embodiment of the present invention. The coolant gas bottle 800 is not provided with an independent nozzle portion 102 but provided with a neck portion 802' thereof.

What is claimed is:

1. A self-cooling liquid container having a liquid cooling device for cooling a liquid in a container by evaporation of a coolant gas comprising:

a coolant gas bottle inside the liquid container containing a coolant gas stored under pressure;

a nozzle tube communicating with the coolant gas bottle and disposed around the coolant gas bottle, the nozzle tube having a first end connected to the coolant gas bottle;

a mounting support for mounting and supporting the coolant gas bottle into the liquid container; and a switching portion connected to a second end of the nozzle tube to selectively release the coolant gas contained in the coolant gas bottle through the nozzle tube.

2. The self-cooling liquid container as claimed in claim 1, wherein the nozzle tube is spirally disposed around the coolant gas bottle in a coil-shape.

3. The self-cooling liquid container as claimed in claim 1, wherein the liquid cooling device is mounted inside a can.

4. The self-cooling liquid container as claimed in claim 1, wherein the liquid cooling device is mounted on a bottom of a bottle by the mounting support.

5. The self-cooling liquid container as claimed in claim 1, wherein the liquid cooling device is mounted to a flexible container formed of paper, synthetic resins and pouch.

6. The self-cooling liquid container as claimed in claim 1, wherein the liquid cooling device is mounted to a container cap.

7. The self-cooling liquid container as claimed in claim 6, wherein the container cap is provided at its end with an opening identification skirt.

8. The self-cooling liquid container as claimed in claim 1, wherein the switching portion is provided with a switching protrusion downwardly forced by an inner spring.

9. The self-cooling liquid container as claimed in claim 1, wherein the mounting support is elastically mounted on a bottom of the container and is formed with a hole for releasing a coolant gas emitting from the switching portion of the nozzle tube connected to the coolant gas bottle.

10. The self-cooling liquid container as claimed in claim 9, wherein the mounting support is provided with a seal-ring for sealing the container therewith.

11. The self-cooling liquid container as claimed in claim 1, wherein a cap is provided with a pulling knob for breaking a separating guide line.

12. The self-cooling liquid container as claimed in claim 1,wherein a cap is screwed with the bottom of the mounting support.

13. The self-cooling liquid container as claimed in claim 1, wherein the switching portion is selectively opened by a cap and the cap is formed at its inside with a protrusion that opens the switching portion when the cap is rotated in an opening direction.

14. The self-cooling liquid container as claimed in claim 1, wherein a cap is formed with a gas emitting groove for emitting the coolant outside from the switching portion.

15. The self-cooling liquid container as claimed in claim 9, wherein the mounting support is formed in its through hole with an annular groove for receiving the protrusion.

16. The self-cooling liquid container as claimed in claim 1, wherein the nozzle tube is rounded around the coolant gas bottle in an irregular diameter.

17. The self-cooling liquid container as claimed in claim 1, wherein the nozzle tube is longitudinally bent several times.

18. The self-cooling liquid container as claimed in claim 1, wherein the nozzle tube is further provided with a reinforcement part for preventing a deformation.

19. The self-cooling liquid container as claimed in claim 9, wherein the switching protrusion is formed at its inside with an emitting hole for emitting the coolant gas.

20. The self-cooling liquid container as claimed in claim 19, wherein the switching protrusion is sharpen at its end, the cap protrusion is located in the space where the switching protrusion is located and is formed at its circumference with an annular band.

21. The self-cooling liquid container as claimed in claim 1, wherein the mounting support is formed in its through hole with a thread and a cap is formed at the circumference of the cap protrusion with a thread for engaging with the through hole thread.

22. The self-cooling liquid container as claimed in claim 1, wherein the mounting support is formed with a gas emitting groove extended from the bottom of the annular protrusion to a position near a sealing packing.

23. The self-cooling liquid container as claimed in claim 1, wherein a sealing packing is located in the end of the switching portion and a protruded needle is formed at the end of the cap protrusion thereby emitting the coolant gas through the sealing packing.

24. The self-cooling liquid container as claimed in claim 23, wherein the cap protrusion is formed at its circumference with a thread portion thereby engaging with the mounting support.

25. The self-cooling liquid container as claimed in claim 23, Wherein the cap protrusion and protruded needle is formed with a gas emitting groove for emitting the coolant gas emitted through the switching portion.

26. The self-cooling liquid container as claimed in claim 23, wherein an annular jaw is formed below the sealing packing for supporting the packing, end a gas emitting groove is horizontally bored through the annular jaw.

27. The self-cooling liquid container as claimed in claim 1, wherein the liquid cooling device is designed such that, if the pressure of the coolant bottle increases and continuously over-presses the nozzle tube, the switching protrusion and the sealing packing deform thereby releasing the coolant gas of the coolant bottle for preventing explosion over allowable pressure.

* * * * *